US011312128B2

(12) United States Patent
Suzuki et al.

(10) Patent No.: US 11,312,128 B2
(45) Date of Patent: Apr. 26, 2022

(54) HEAD DRIVING DEVICE, LIQUID DISCHARGE APPARATUS, AND HEAD DRIVING METHOD

(71) Applicant: Ricoh Company, Ltd., Tokyo (JP)

(72) Inventors: Takuya Suzuki, Kanagawa (JP); Hiroshi Takahashi, Kanagawa (JP); Keiji Kojima, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 81 days.

(21) Appl. No.: 16/896,307

(22) Filed: Jun. 9, 2020

(65) Prior Publication Data

US 2020/0398554 A1 Dec. 24, 2020

(30) Foreign Application Priority Data

Jun. 21, 2019 (JP) ..... JP2019-115755

(51) Int. Cl.
*B41J 2/045* (2006.01)

(52) U.S. Cl.
CPC ..... *B41J 2/04505* (2013.01)

(58) Field of Classification Search
CPC ..... B41J 2/04505
See application file for complete search history.

(56) References Cited

U.S. PATENT DOCUMENTS 6,464,321 B1 10/2002 Nunokawa
6,851,783 B1 2/2005 Gupta et al.
7,106,476 B1 9/2006 Tonami et al.
2002/0131061 A1 9/2002 Aoyagi et al.
2003/0169455 A1 9/2003 Takahashi et al.
2005/0002048 A1 1/2005 Takahashi et al.
2005/0219567 A1 10/2005 Gupta et al.
2009/0051735 A1 2/2009 Takahashi et al.
(Continued)

FOREIGN PATENT DOCUMENTS

EP 1 097 817 A1 5/2001
JP 2011-218657 A 11/2011
(Continued)

OTHER PUBLICATIONS

Machine translation of JP 2018-043398 A. (Year: 2018).*
(Continued)

*Primary Examiner* — Justin Seo
(74) *Attorney, Agent, or Firm* — Xsensus LLP

(57) ABSTRACT

A head driving device includes a recording head, an input-and-output interface, and circuitry. The recording head includes a plurality of nozzles and a plurality of pressure generating elements corresponding to the plurality of nozzles. The input-and-output interface is configured to acquire correction information generated based on a chart image of a specific pattern for correcting a deviation amount of a landing position of each of the plurality of nozzles. The circuitry is configured to set the correction information acquired by the input-and-output interface and perform correction processing for correcting the deviation amount of the landing position on a driver for each of the plurality of nozzles of the recording head, in accordance with the correction information.

6 Claims, 13 Drawing Sheets

(56) References Cited

U.S. PATENT DOCUMENTS

| | | | | |
|---|---|---|---|---|
| 2010/0220365 | A1* | 9/2010 | Sasayama | B41J 2/2146<br>358/448 |
| 2011/0187777 | A1* | 8/2011 | Shin | B41J 29/38<br>347/14 |
| 2012/0229546 | A1* | 9/2012 | Okada | B41J 2/2142<br>347/14 |
| 2013/0044342 | A1 | 2/2013 | Kaneko et al. | |
| 2020/0269572 | A1* | 8/2020 | Kurihara | B41J 2/04558 |

FOREIGN PATENT DOCUMENTS

| | | |
|---|---|---|
| JP | 2015-231735 | 12/2015 |
| JP | 2018-043398 | 3/2018 |

OTHER PUBLICATIONS

Extended European Search Report dated Nov. 3, 2020 in corresponding European Patent Application No. 20180883.9, 10 pages.

* cited by examiner

HEAD DRIVING DEVICE, LIQUID DISCHARGE APPARATUS, AND HEAD DRIVING METHOD

CROSS-REFERENCE TO RELATED APPLICATION

This patent application is based on and claims priority pursuant to 35 U.S.C. § 119(a) to Japanese Patent Application No. 2019-115755, filed on Jun. 21, 2019, in the Japan Patent Office, the entire disclosure of which is hereby incorporated by reference herein.

BACKGROUND

Technical Field

Embodiments of the present disclosure relate to a head driving device, a liquid discharge apparatus, and a head driving method.

Related Art

A recording head (droplet discharge head) is used in a liquid discharge apparatus such as an image forming apparatus of an ink jet system or an image forming apparatus that stacks discharged ink to perform three-dimensional fabrication. Such a recording head needs to reduce variations in amount of ink droplets and landing position to improve image quality. High-speed machines that perform high-speed printing have much higher needs for the reduction of the variations than medium-speed and low-speed machines.

However, in the recording head, there are structural variations in piezoelectric elements, members, or the like provided for respective nozzles. Even if a drive signal having a drive waveform appropriately set in consideration of the ink droplet speed, the stability of the discharge state, and the like is used, there occur variations in the amount of ink droplets or the landing position and image quality deteriorates.

Hence, there is known a technique of controlling the landing positions of ink droplets in accordance with the variations in the landing positions.

SUMMARY

In an aspect of the present disclosure, there is provided a head driving device that includes a recording head, an input-and-output interface, and circuitry. The recording head includes a plurality of nozzles and a plurality of pressure generating elements corresponding to the plurality of nozzles. The input-and-output interface is configured to acquire correction information generated based on a chart image of a specific pattern for correcting a deviation amount of a landing position of each of the plurality of nozzles. The circuitry is configured to set the correction information acquired by the input-and-output interface and perform correction processing for correcting the deviation amount of the landing position on a driver for each of the plurality of nozzles of the recording head, in accordance with the correction information.

In another aspect of the present disclosure, there is provided a liquid discharge apparatus that includes the head driving device.

In still another aspect of the present disclosure, there is provided a method of driving a recording head of a head driving device. The recording head includes a plurality of nozzles and a plurality of pressure generating elements corresponding to the plurality of nozzles. The method includes acquiring correction information for correcting a deviation amount of a landing position of each of the plurality of nozzles generated based on a charge image of a specific pattern; setting the correction information acquired by the acquiring; and performing correction processing for correcting the deviation amount of the landing position on a driver for each of the plurality of nozzles of the recording head, in accordance with the correction information set by the setting.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
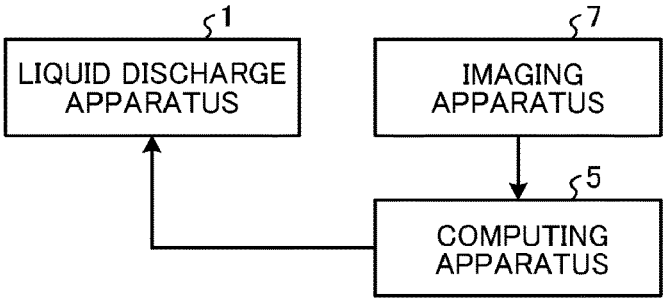
FIG. 1 is a diagram of a system configuration of a liquid discharge system according to an embodiment.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, a liquid discharge system according to an embodiment is described with reference to the accompanying drawings. The present embodiment is described as a liquid discharge apparatus that discharges ink (liquid) from a head to form an image on a medium. However, the present invention is also applicable to, for example, a three dimensional fabricating apparatus that discharges ink (liquid) from a head and stack layers to fabricate a three-dimensional object on a medium.

System Configuration

FIG. 1 is a diagram of a system configuration of a liquid discharge system according to an embodiment. As illustrated in FIG. 1, the liquid discharge system according to the present embodiment includes a liquid discharge apparatus 1, a computing apparatus 5, and an imaging apparatus 7. The liquid discharge apparatus 1 prints a test chart (an example of a chart image of a specific pattern) described later, and the imaging apparatus 7 images the printed test chart. The computing apparatus 5 analyzes the imaging data of the pattern of the test chart to detect the deviation amount of the landing position for each nozzle 4 of a recording head of the liquid discharge apparatus 1. Based on the detection result, the computing apparatus 5 forms correction information for correcting the deviation of the landing position of each nozzle and sets the correction information in the liquid discharge apparatus 1. The liquid discharge apparatus 1 performs discharge control of ink of each nozzle based on the set correction information. Such a configuration can obtain a printed material in which the deviation of the landing position is corrected, thus achieving high image quality.

In the example of FIG. 1, the liquid discharge apparatus 1, the computing apparatus 5, and the imaging apparatus 7 are illustrated as physically independent apparatuses. However, in some embodiment, the arithmetic function of the computing apparatus 5 and the imaging function of the imaging apparatus 7 may be provided in the liquid discharge apparatus 1 to form a physically single apparatus. Alternatively, one of the arithmetic function of the computing apparatus 5 and the imaging function of the imaging apparatus 7 may be provided in the liquid discharge apparatus 1.

Configuration of Liquid Discharge Apparatus

Figure 2:
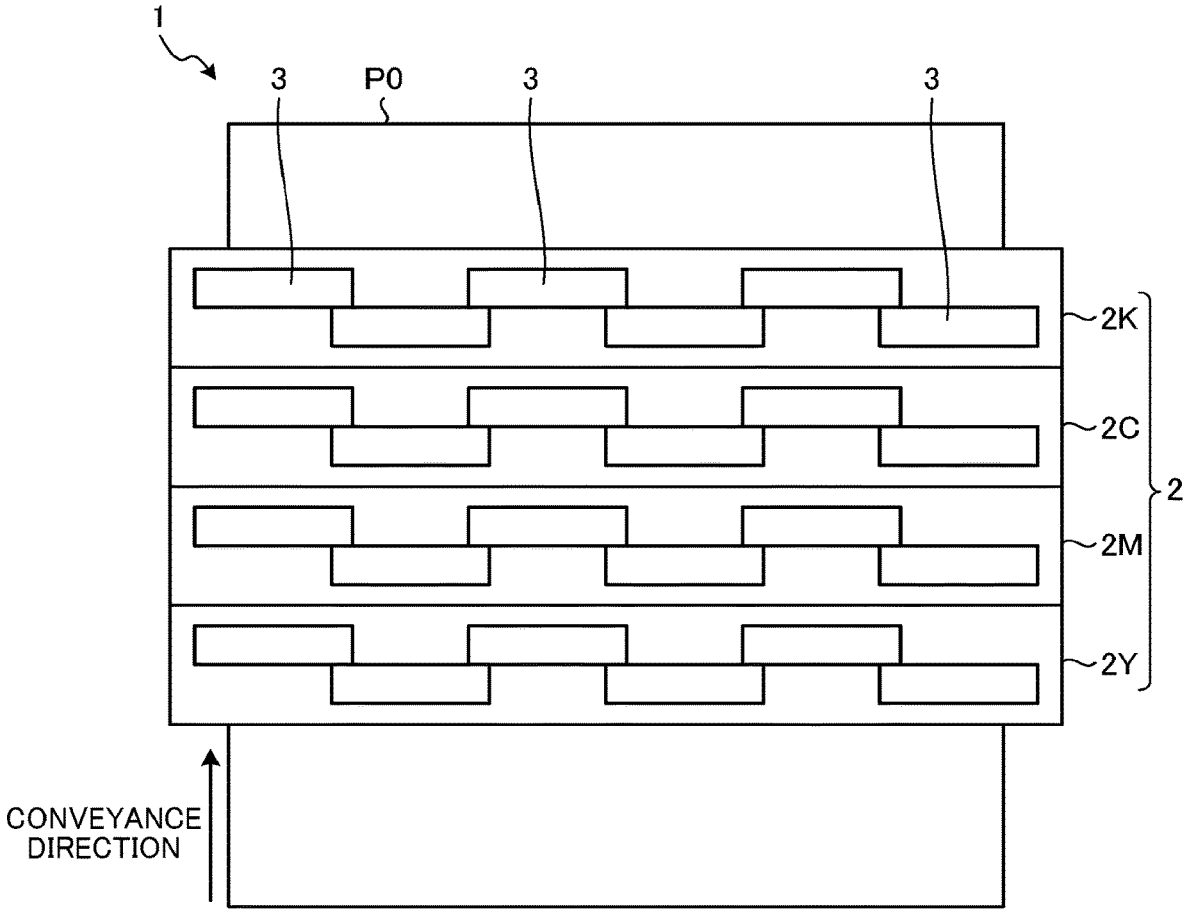
FIG. 2 is a plan view of the liquid discharge apparatus viewed from vertically above a recording medium.

FIG. 2 is a plan view of the liquid discharge apparatus 1 viewed from above a recording medium P0. The recording medium P0 is, for example, a sheet of paper and may be a roll paper sheet (continuous paper sheet), cut sheet paper, or the like. Alternatively, various media other than a sheet of paper may be used. The recording medium P0 is conveyed along a conveyance direction indicated by an arrow in FIG. 1. A head device 2 is supported to face a recording surface of the recording medium P0 at a predetermined distance.

The head device 2 includes a K recording unit 2K, a C recording unit 2C, an M recording unit 2M, and a Y recording unit 2Y for colors provided corresponding to inks of black (K), cyan (C), magenta (M), and yellow (Y), respectively. The head device 2 discharges ink droplets in synchronization with the sheet conveyance speed to form a color image on the recording medium P0. Note that the number of recording units of the head device 2 and the color of ink are not limited to any particular number and color. For example, the head device 2 may be a head device that includes only a single black recording unit and performs recording with a single black color.

Configuration of Nozzle Arrangement of Recording Head

Figure 3:
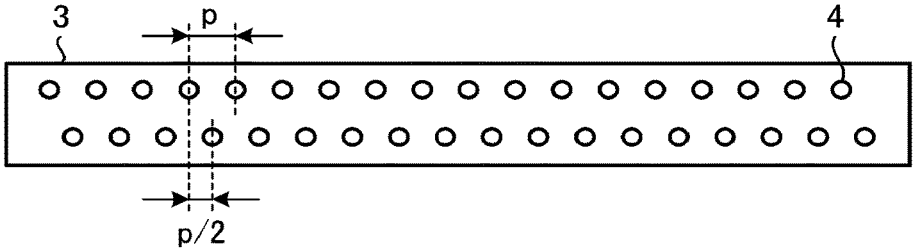
FIG. 3 is a diagram illustrating a nozzle arrangement configuration of a plurality of recording heads in each recording unit of a head device.

FIG. 3 is a diagram illustrating a nozzle arrangement configuration of a plurality of recording heads 3 in each recording unit of the head device 2. In FIG. 3, in the recording head 3, a plurality of nozzles 4 is arranged at a predetermined pitch p in a direction orthogonal to the sheet conveyance direction, which may be hereinafter referred to as a "nozzle row direction". In the example of FIG. 2, two nozzle rows are provided for one recording head 3. The first nozzle row and the second nozzle row are arranged to be shifted by p/2 along the nozzle row direction. Such an arrangement allows printing with high resolution in the nozzle row direction.

Hardware Configuration of Liquid Discharge Apparatus

Figure 4:
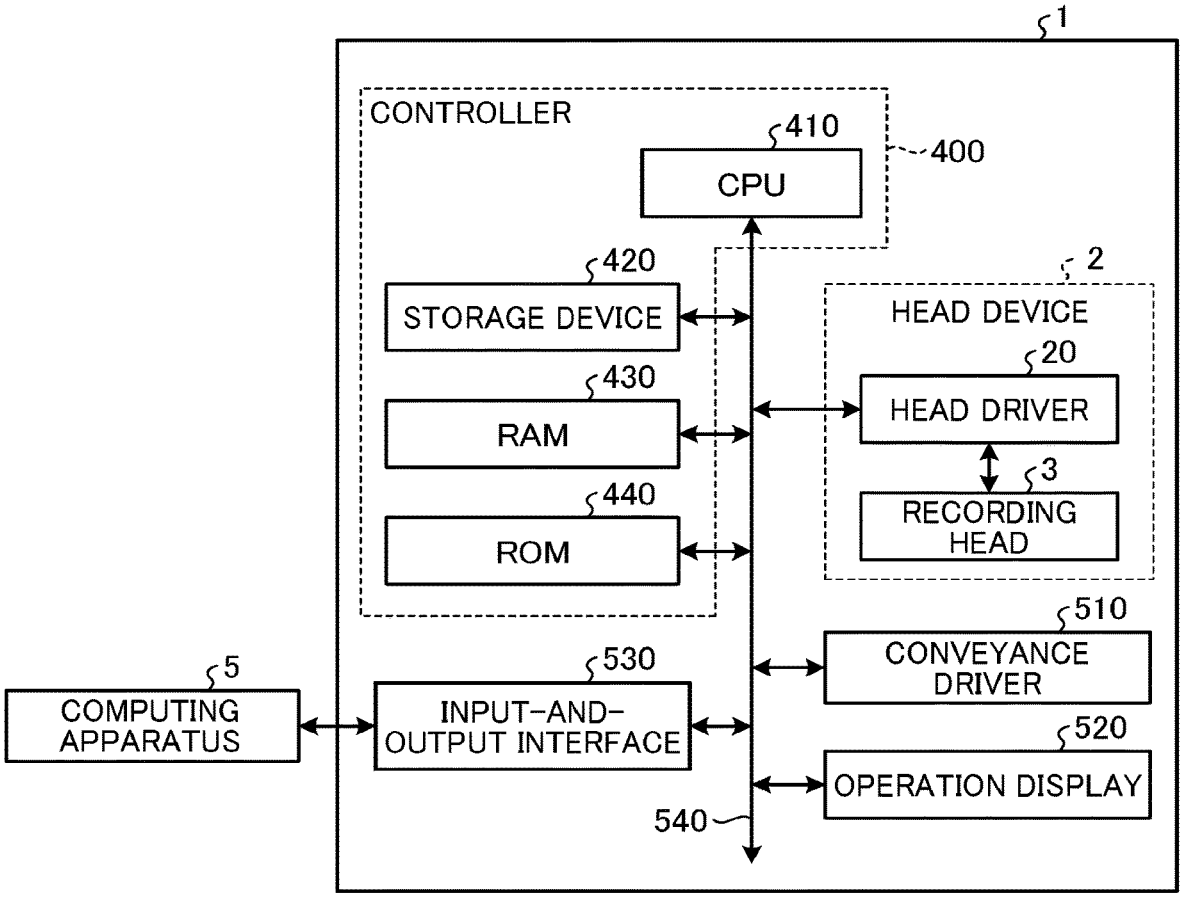
FIG. 4 is a diagram illustrating a hardware configuration of a main part of the liquid discharge apparatus.

FIG. 4 is a diagram illustrating a hardware configuration of a main part of the liquid discharge apparatus 1. In FIG. 4, the liquid discharge apparatus 1 includes a controller 400, the head device 2, a conveyance driver 510, an operation display 520, and an input-and-output interface 530 that are connected to each other via a bus line 540.

The head device 2 includes a head driver 20 and the recording head 3. The head device 2 supplies a drive waveform for deforming a piezoelectric element in the head driver 20 to the head driver 20 in accordance with a control signal input from the controller 400. Thus, ink is discharged from the nozzles 4 of the recording head 3.

The controller 400 includes a central processing unit (CPU) 410, a storage device 420, a random access memory (RAM) 430, and a read only memory (ROM) 440. The CPU 410 reads various control programs and setting data stored in the ROM 440, stores the control programs and the setting data in the RAM 430, and executes the control programs to perform various arithmetic processing. The CPU 410 controls the entire operation of the liquid discharge apparatus 1.

The storage device 420 stores a print job (image recording command) and image data to be printed, which are input from the computing apparatus 5 via the input-and-output interface 530 (an example of an acquisition unit), and correction information for correcting the landing position of each nozzle 4, which is generated based on the test chart for detecting the landing position of ink, which is described later.

The conveyance driver 510 supplies a drive signal to a conveyance motor based on a control signal supplied from the controller 400 and conveys the recording medium P0 at a predetermined speed and timing. The operation display 520 includes a display device such as a liquid crystal display or an organic electroluminescent (EL) display and an input device such as an operation key and a touch panel arranged to be overlaid on a screen of the display device. The operation display 520 displays various types of information on the display device and supplies an operation signal corresponding to an input operation of the user to the input device to the controller 400.

The input-and-output interface 530 mediates transmission and reception of data between the computing apparatus 5 and the controller 400. The bus line 540 is a path for transmitting and receiving signals between the controller 400 and other components.

Hardware Configuration of Head Driver

Figure 5:
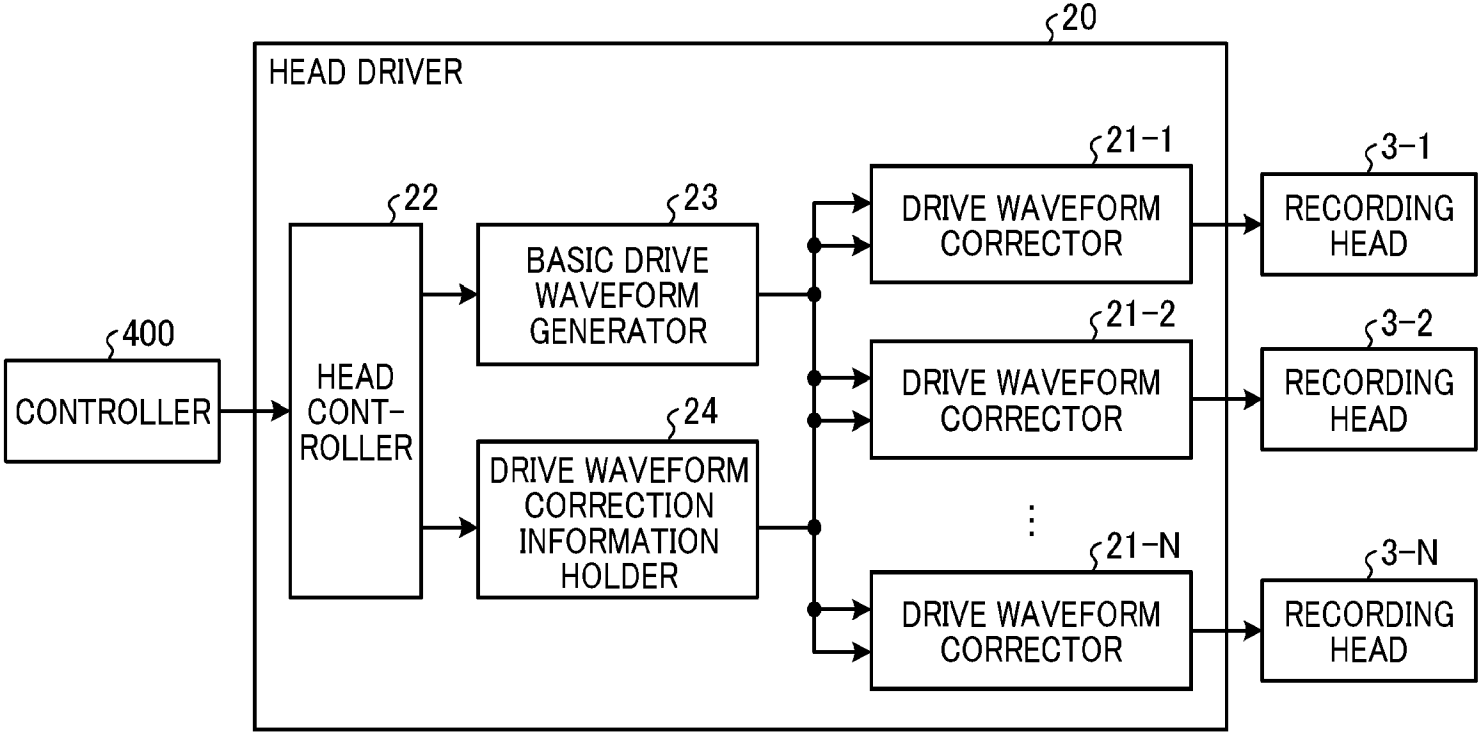
FIG. 5 is a diagram illustrating a hardware configuration of a head driver of the head device.

FIG. 5 is a diagram illustrating a hardware configuration of the head driver 20 of the head device 2. In FIG. 5, the head driver 20 includes a plurality of drive waveform correctors 21-1 to 21-N corresponding to the plurality of nozzles 4, a head controller 22, a basic drive waveform generator 23, and a drive waveform correction information holder 24.

The head controller 22 converts the image data input from the controller 400 to a control signal for controlling each of the recording heads 3-1 to 3-N (N represents the number of nozzles). The basic drive waveform generator 23 generates a basic drive waveform that enables a reference discharge operation in accordance with an image pattern, a conveyance speed, and printing environments, such as temperature and humidity, based on the control signal input from the head controller 22.

The drive waveform correction information holder 24 stores information indicating a nozzle number of a nozzle to be corrected and information indicating a correction amount. The drive waveform correctors 21-1 to 21-N (N represents the number of nozzles) correct the basic drive waveform of the drive voltage supplied from the basic drive waveform generator 23 based on the correction information read from the drive waveform correction information holder 24, and supplies the basic drive waveform to the piezoelectric elements in the recording head 3-1 to 3-N (N represents the number of nozzles). Thus, different discharge characteristics are given to the nozzles 4.

Configuration of Imaging Apparatus

Figure 6:
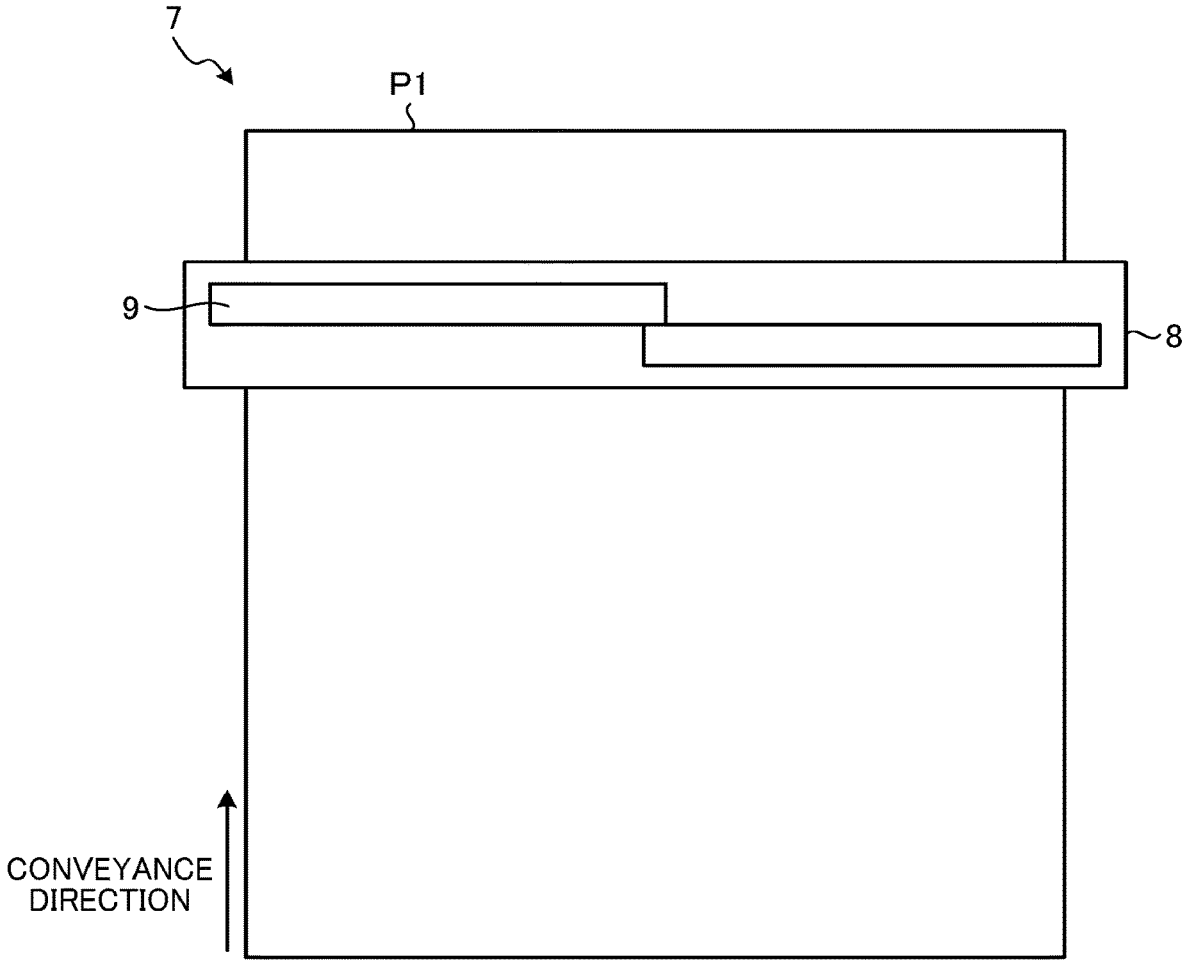
FIG. 6 is a plan view of an imaging apparatus viewed from vertically above a recording medium.

FIG. 6 is a plan view of the imaging apparatus 7 viewed from above a recording medium P1 in the vertical direction. As illustrated in FIG. 6, the recording medium P1 on which an image is printed by the liquid discharge apparatus 1 is conveyed in a conveyance direction. The imaging unit 8 is supported so as to face a recording surface of the recording medium P1. The imaging unit 8 includes an imaging device 9 such as a line camera device or an area camera device and images a surface of the recording medium P1 across the entire width or a part of the width of the recording medium P1 in synchronization with the conveyance speed of the recording medium P1.

Configuration of Imaging Device

Figure 7:
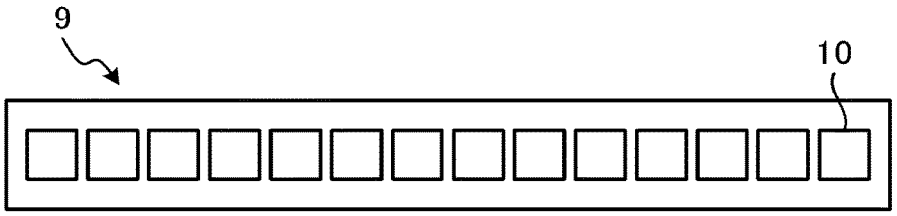
FIG. 7 is a schematic view of an imaging unit viewed from an imaging surface side.

FIG. 7 is a view of the imaging unit 8 viewed from the imaging surface side. As illustrated in FIG. 7, an imaging device 9 includes a plurality of imaging elements 10 arranged at equal intervals along the width direction of the recording medium P1 (that is a direction two-dimensionally orthogonal to the conveyance direction, in other words, a main scanning direction). The imaging unit 8 simultaneously captures an image of the surface of the recording medium P1 with an imaging element group including the plurality of imaging elements 10 to generate image data. Note that the number of imaging elements 10 illustrated in FIG. 7 is smaller than the actual number for simplicity.

Hardware Configuration of Imaging Apparatus

Figure 8:
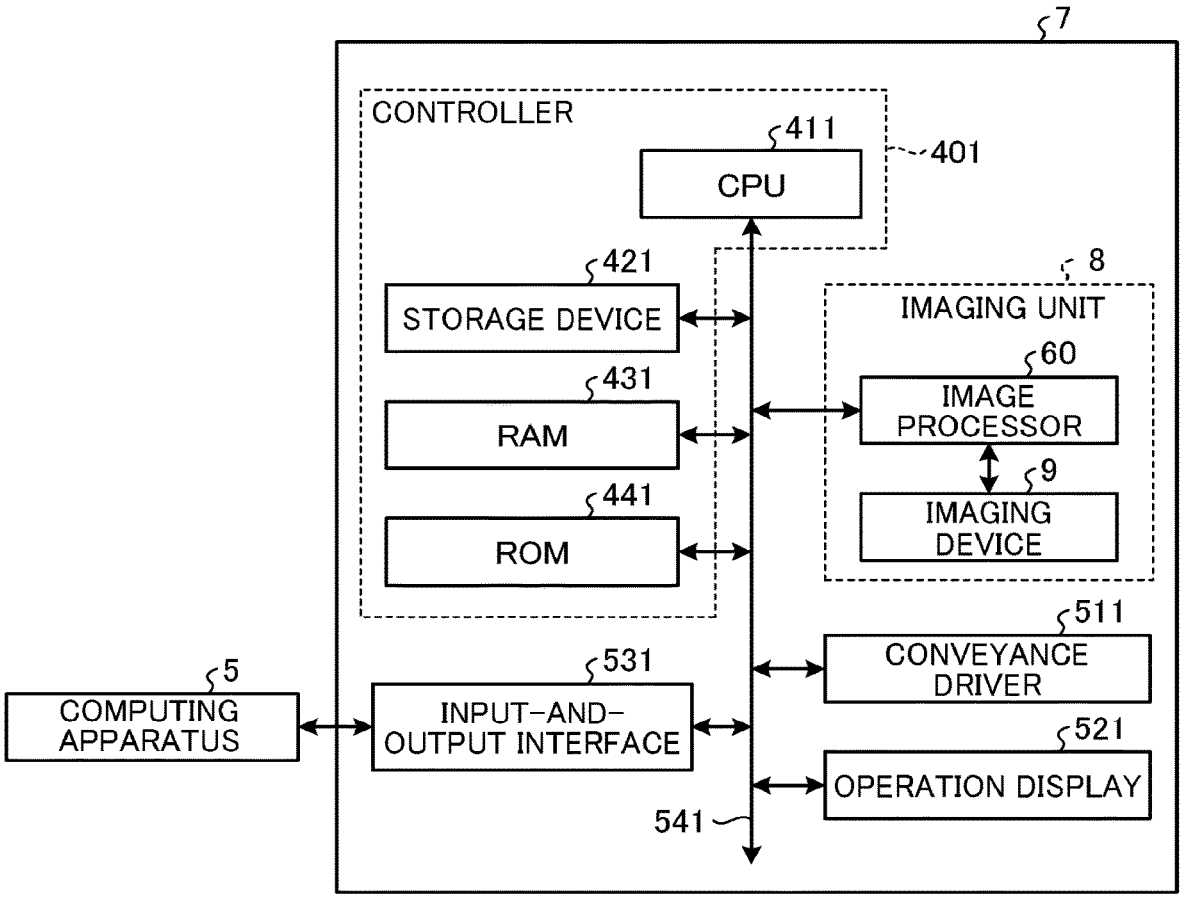
FIG. 8 is a block diagram illustrating a hardware configuration of the imaging apparatus.

FIG. 8 is a block diagram illustrating a hardware configuration of the imaging apparatus 7. As illustrated in FIG. 8, the imaging apparatus 7 includes the imaging unit 8 having the imaging device 9 and an image processor 60, a controller 401, a conveyance driver 511, an operation display 521, and an input-and-output interface 531 that are connected to each other via a bus line 541.

The imaging device 9 captures, with each imaging element 10, an image of the surface of the recording medium P1 being conveyed. The image processor 60 generates imaging data based on the imaging output captured by each imaging element 10. Among the imaging data generated by the image processor 60, imaging data of a test chart described later is transmitted to the computing apparatus 5 via the input-and-output interface 531. As described later, the computing apparatus 5 detects the landing position of an ink droplet from each nozzle 4 based on the imaging data of the test chart, and calculates correction information for correcting the basic drive waveform of the drive voltage supplied to each of the recording heads 3-1 to 3-N based on the amount of deviation of the landing position. The correction information is transmitted from the computing apparatus 5 to the liquid discharge apparatus 1 and stored in the storage device 420 illustrated in FIG. 4.

In the present example, the calculation of the correction information is performed by the computing apparatus 5. However, in some embodiments, the calculation of the correction information may be performed by, for example, the image processor 60.

The controller 401 includes a CPU 411, a storage device 421, a RANI 431, and a ROM 441. The basic operations of the controller 401, the CPU 411, the storage device 421, the RAM 431, and the ROM 441 are similar to, even if not the same as, the basic operations of the controller 400, the CPU 410, the storage device 420, the RAM 430, and the ROM 440 of the liquid discharge apparatus 1 illustrated in FIG. 4. The basic operations of the conveyance driver 511, the operation display 521, and the input-and-output interface 531 are the same as the basic operations of the conveyance driver 510, the operation display 520, and the input-and-output interface 530 of the liquid discharge apparatus 1 illustrated in FIG. 4.

Hardware Configuration of Computing Apparatus

Figure 9:
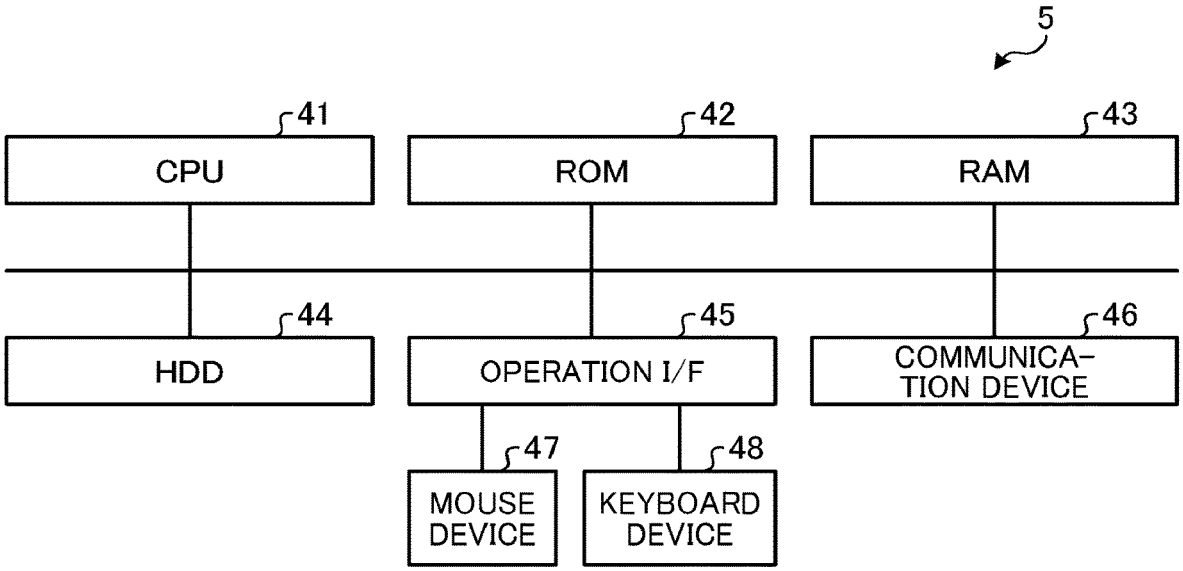
FIG. 9 is a diagram illustrating a hardware configuration of a computing apparatus.

FIG. 9 is a diagram illustrating a hardware configuration of the computing apparatus 5. As illustrated in FIG. 9, the computing apparatus 5 includes a CPU 41, a ROM 42, a RAM 43, a hard disk drive (HDD) 44, an operation interface (operation I/F) 45, and a communication device 46. Operation devices such as a mouse device 47 and a keyboard device 48 are connected to the operation I/F 45.

The computing apparatus 5 transmits a print job, image data, and the like to the liquid discharge apparatus 1 via the communication device 46. A storage device such as the ROM 42, the RAM 43, or the HDD 44 of the computing apparatus 5 stores a computing program for calculating correction information for correcting the basic drive waveform of the drive voltage supplied to each of the recording heads 3-1 to 3-N based on the deviation amount of the landing position for each nozzle 4 based on the imaging data of the test chart.

Figure 10:
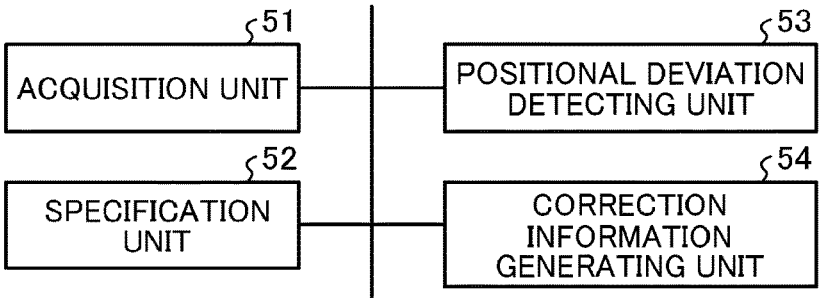
FIG. 10 is a functional block diagram of functional units implemented by a central processing unit (CPU) of the computing apparatus executing a computing program.

FIG. 10 is a functional block diagram of each function implemented by the CPU 41 of the computing apparatus 5 executing the computing program. As illustrated in FIG. 10, the CPU 41 of the computing apparatus 5 executes a computing program to implement functions of an acquisition unit 51, a specification unit 52, a positional deviation detecting unit 53, and a correction information generating unit 54. The CPU 41 of the computing apparatus 5 calculates correction information of each of the recording heads 3-1 to 3-N based on the computing program and transmits the correction information to the liquid discharge apparatus 1.

Example of Test Chart

FIG. 11 is a diagram illustrating an example of a test chart printed on the recording medium P0. A test chart i-11 illustrated in FIG. 11A is a test chart including independent dots formed by ink discharged from the nozzles 4. The dots of the test chart are printed by shifting the discharge positions from some of the nozzles 4 in the conveyance direction so that the inks discharged from the nozzles 4 do not overlap each other. Accordingly, the coordinates of the landing position of the ink from each nozzle 4 can be specified from the position of the dot in the test chart i-11.

Figure 11A:
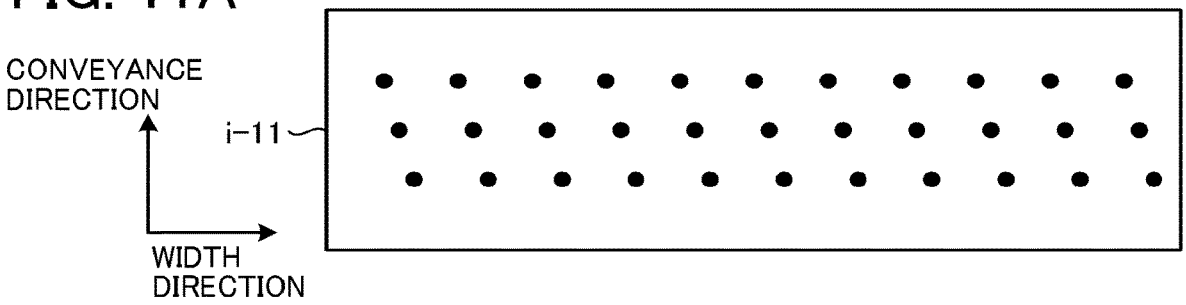
FIGS. 11A to 11D are diagrams illustrating examples of a test chart printed on the recording medium.
Figure 11B:
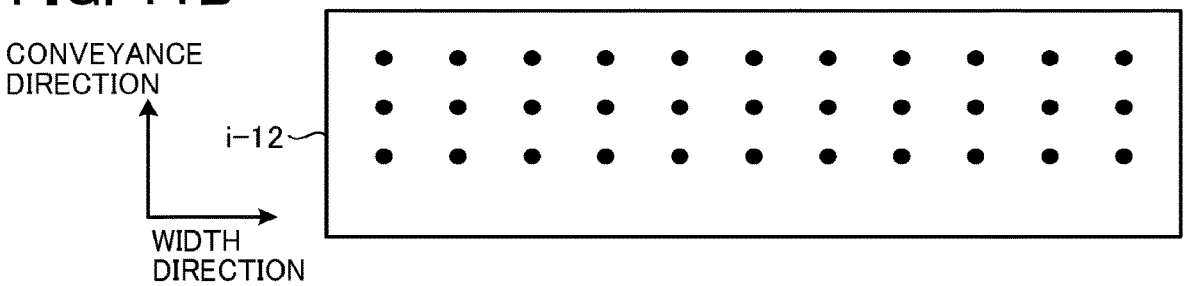

As illustrated in a test chart i-12 of FIG. 11B, after ink droplets are discharged from the same nozzle 4 at equal intervals to record a predetermined number of dots, the discharge position may be shifted by any number of nozzles to record dots.

Figure 11C:
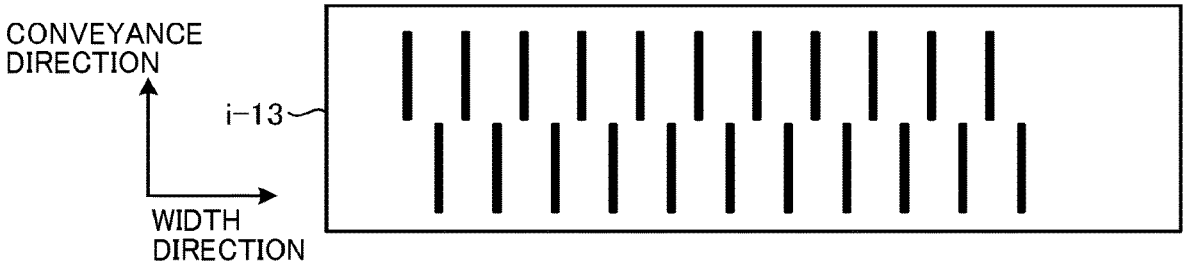

As in a test chart i-13 of FIG. 11C, a plurality of line segments continuous in the conveyance direction may be printed. In the case of the test chart i-13, the coordinates of the landing position from each nozzle 4 can be specified in the width direction (main scanning direction) from the position of each line segment. A variation component for each nozzle 4 in high-frequency discharge can also be specified from the length of the start point and the end point of the line segment.

Figure 11D:
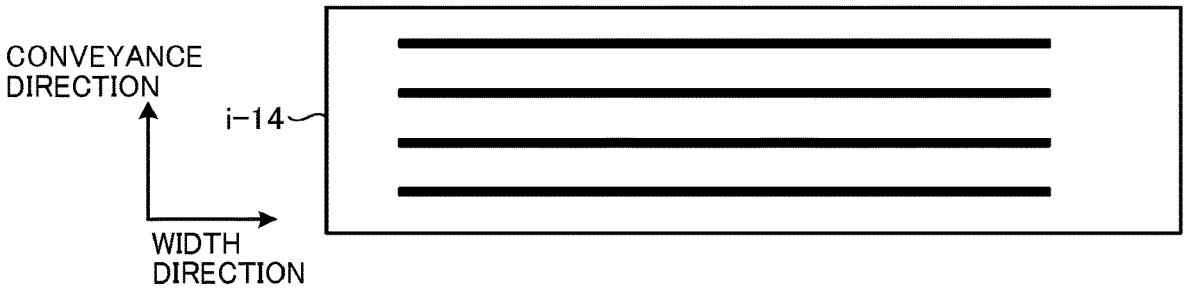

As in a test chart i-14 of FIG. 11D, adjacent (continuous) line segments may be printed along the width direction (main scanning direction). In the case of the test chart i-14, the nozzle number of the nozzle 4 forming the line segment is detected from the positions of both ends of each line segment, and the coordinates of the landing position of each nozzle 4 can be specified from the unevenness of the line segment. A variation component due to mutual interference between adjacent nozzles 4 can also specified.

Operation of Generating Correction Information

Next, a description is given of an operation of generating correction information for correcting the basic drive waveform of the drive voltage supplied to each of the recording heads 3-1 to 3-N, which is performed using such a test chart.

First, before shipping the liquid discharge apparatus 1, the above-described test chart is printed by the liquid discharge apparatus 1 to be shipped. The printed test chart is imaged by the imaging apparatus 7. The imaging unit 8 illustrated in FIG. 8 transmits imaging data of the imaged test chart to the computing apparatus 5 via the input-and-output interface 531. The computing apparatus 5 executes the computing program stored in the storage device such as the HDD 44 to calculate a deviation amount of the landing position (discharge position) of each nozzle 4 from the imaging data of the test chart and calculates correction information for correcting the deviation amount for each of the recording heads 3-1 to 3-N.

Figure 12:
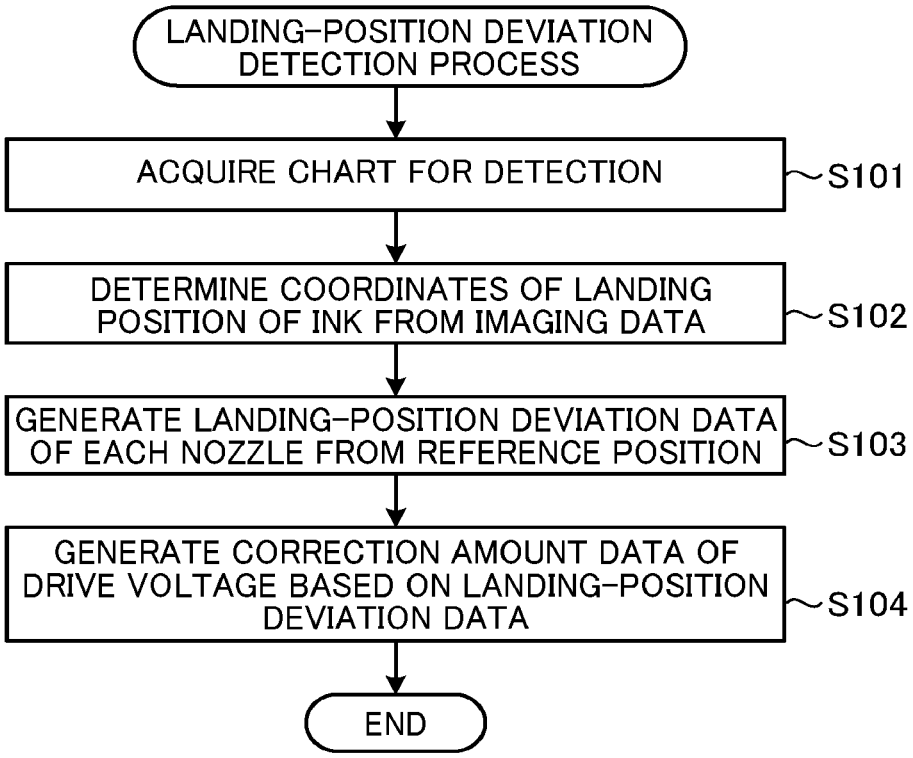
FIG. 12 is a flowchart illustrating a flow of an operation of generating correction information executed by the CPU of the computing apparatus based on a computing program stored in the storage device.

The flowchart of FIG. 12 is a flowchart illustrating the flow of the operation of generating the correction information executed by the CPU 41 of the computing apparatus 5 based on the computing program stored in the storage device such as the HDD 44. In the flowchart of FIG. 12, first, the acquisition unit 51 illustrated in FIG. 10 acquires (receives) the imaging data of the test chart transmitted from the imaging apparatus 7 (step S101).

Next, the specification unit 52 specifies the coordinates of the landing position of ink for each of the nozzles 4 based on the acquired imaging data (step S102). Next, the positional deviation detecting unit 53 detects the positional deviation amount from a "reference position" for each nozzle 4 (step S103). That is, the positional deviation detecting unit 53 detects the distance by which the discharge position of a dot from each nozzle 4 is separated from the reference position of the dot from each nozzle 4.

As an example, the position information of a predetermined position or an average value of coordinates of landing positions of one row of the nozzles 4 in the width direction (main scanning direction) can be used as the "reference position".

Next, the correction information generating unit 54 generates the correction information of the drive voltage for each nozzle 4 based on the positional deviation amount for each nozzle 4 (step S104). The relationship between the positional deviation amount and the correction amount may be determined in advance by experiments and stored as a table in the storage device such as the HDD 44.

The CPU 41 of the computing apparatus 5 transmits the correction information of the drive voltage for each nozzle 4 generated in this manner to the liquid discharge apparatus 1 via the communication device 46. The CPU 410 of the liquid discharge apparatus 1 supplies the correction information received from the computing apparatus 5 to the head driver 20 illustrated in FIG. 5. Based on the supplied correction information, the head controller 22 (an example of a setting unit) of the head driver 20 controls the drive waveform correction information holder 24 to store information indicating the nozzle number of the nozzle 4 to be corrected and information indicating the correction amount. Thus, the basic drive waveform of the drive voltage of the nozzle 4 to be corrected is corrected, and the landing position is corrected.

Operation of Correcting Drive Voltage of Recording Head

Figure 14:
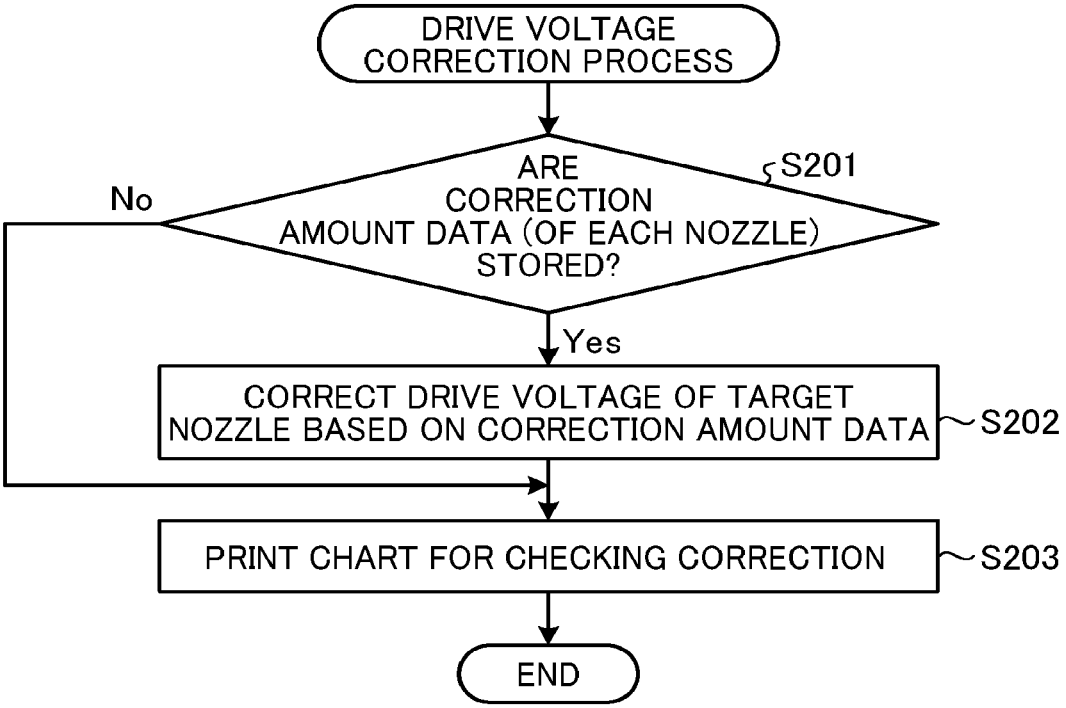
FIG. 14 is a flowchart illustrating the flow of an operation of correcting a drive voltage of a recording head.

The flowchart illustrated in FIG. 14 is a flowchart illustrating the flow of the operation of correcting the drive voltage of each recording head. In the flowchart of FIG. 14, the process is started from step S201 when the liquid discharge apparatus 1 is instructed to print a test chart.

In step S201, the head controller 22 illustrated in FIG. 5 determines whether the information indicating the nozzle number of the nozzle 4 to be corrected and information indicating the correction amount of the nozzle 4 are stored in the drive waveform correction information holder 24. As described later, the head controller 22 detects the nozzle 4 to be corrected based on the correction information stored in the storage device 420, and stores the information indicating the nozzle number of the nozzle 4 and information indicating the correction amount in the drive waveform correction information holder 24.

The fact that the information indicating the nozzle number of the nozzle 4 to be corrected and the information indicating the correction amount are not stored in the drive waveform correction information holder 24 means that the correction information based on the test chart described with reference to the flowchart of FIG. 12 is not generated. Therefore, in a case where the information indicating the nozzle number of the nozzle 4 to be corrected and the information indicating the correction amount are not stored in the drive waveform correction information holder 24 (NO in step S201), the CPU 410 of the liquid discharge apparatus 1 controls printing of the test chart for generating the correction information (step S203). As described above, the test chart is imaged by the imaging apparatus 7. Then, the computing apparatus 5 generates correction information for each nozzle 4 based on the imaging data of the test chart.

On the other hand, in a case where the information indicating the nozzle number of the nozzle 4 to be corrected and the information indicating the correction amount are stored in the drive waveform correction information holder 24 (YES in step S201), the process proceeds to step S202. In step S202, among the drive waveform correctors 21-1 to 21-N, the drive waveform corrector (an example of a correction processing unit) corresponding to the nozzle 4 of the nozzle number to be corrected generates a drive signal of a drive waveform obtained by performing correction corresponding to the above-described correction amount on the basic drive waveform supplied from the basic drive waveform generator 23 (step S202).

Next, in step S203, the drive waveform correctors 21-1 to 21-N drive the recording heads 3-1 to 3-N with the drive signals of the corrected drive waveforms and print the test chart again. Checking the printed test chart again allows determination of whether the deviation of the landing position of each nozzle 4 has been corrected. When the deviation of the landing position of each nozzle 4 has not been corrected, the landing position of each nozzle 4 can be corrected to an accurate position by repeatedly performing the operation of imaging the test chart again and calculating the correction information.

Examples of Operation of Correcting Drive Waveform

Figure 13A:
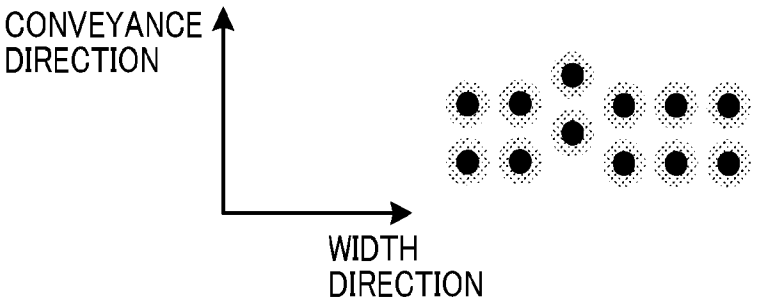
FIGS. 13A to 13D are diagrams illustrating examples of an operation of correcting a drive waveform.

Next, a description is given of an example of the operation of correcting a drive waveform in step S202. FIGS. 13A to 13D are diagrams illustrating examples of the operation of correcting a drive waveform. FIG. 13A illustrates an image in a case where the landing position of ink from a nozzle is advanced from the landing positions of nearby nozzles in the conveyance direction (a case where ink lands at an upper position in FIG. 13A). That is, in the example of FIG. 13A, the discharge timing of the nozzle 4 that discharges the third dot from the left is earlier than the discharge timing of the other nozzles, and thus the landing position is shifted upward.

Figure 13B:
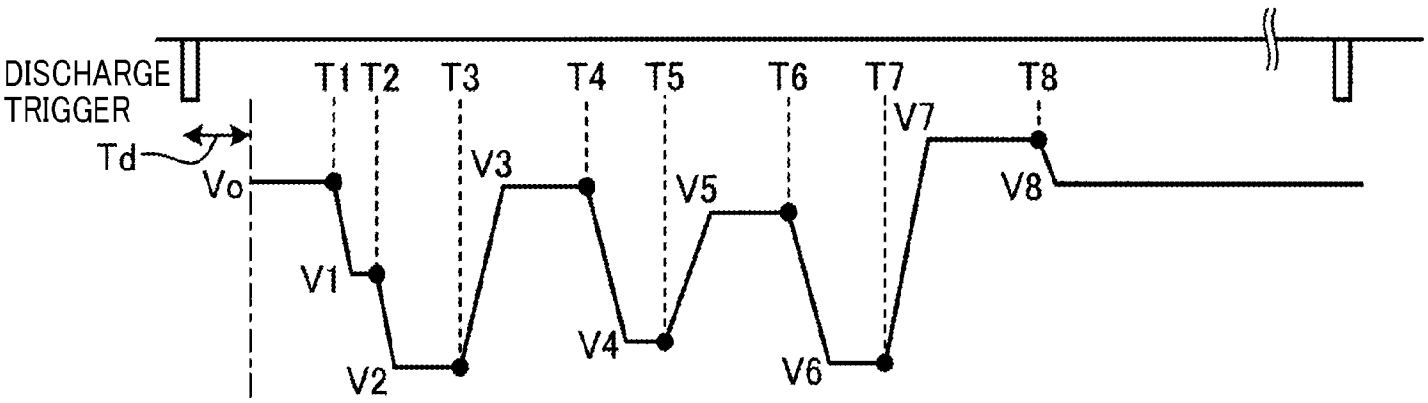
Figure 13C:
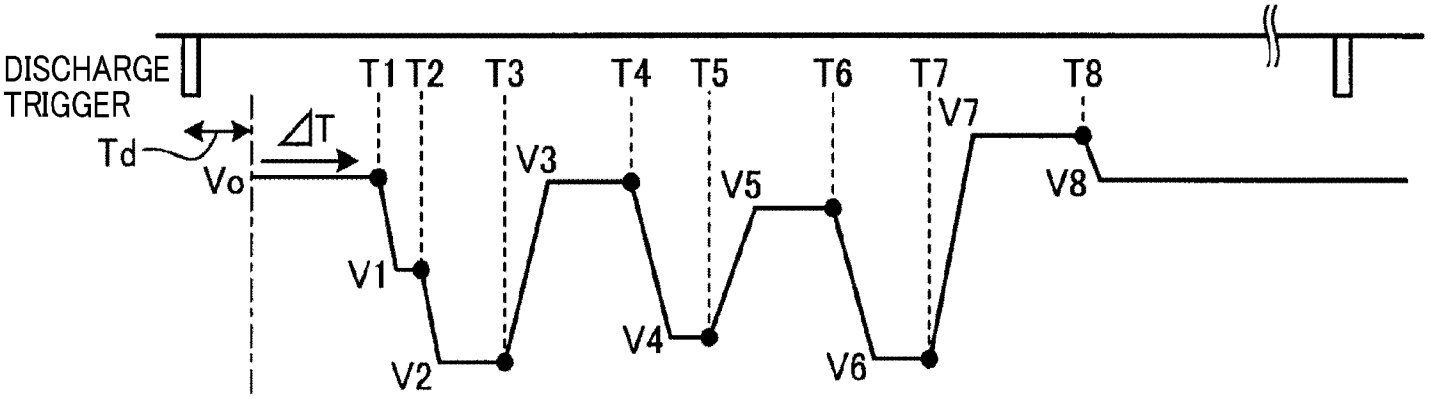

FIG. 13B illustrates an example of the basic drive waveform generated by the basic drive waveform generator 23 illustrated in FIG. 5. In the case of FIG. 13B, the drive waveform corrector (one of 21-1 to 21-N) corresponding to the nozzle 4 whose landing position is advanced from the other nozzles delays the application timing T1 of the basic drive signal of the basic drive waveform by a predetermined time (ΔT) as illustrated in FIG. 13C. Accordingly, since the discharge timing of liquid droplet is delayed, the landing timing can be delayed. Thus, the landing positions of the nozzles 4 can be aligned.

The application timing illustrated in FIG. 13C to be changed is not limited to the timing T1. For example, the rise timings T3, T5, and T7 of the pulses may be delayed to delay the final landing positions.

Figure 13D:
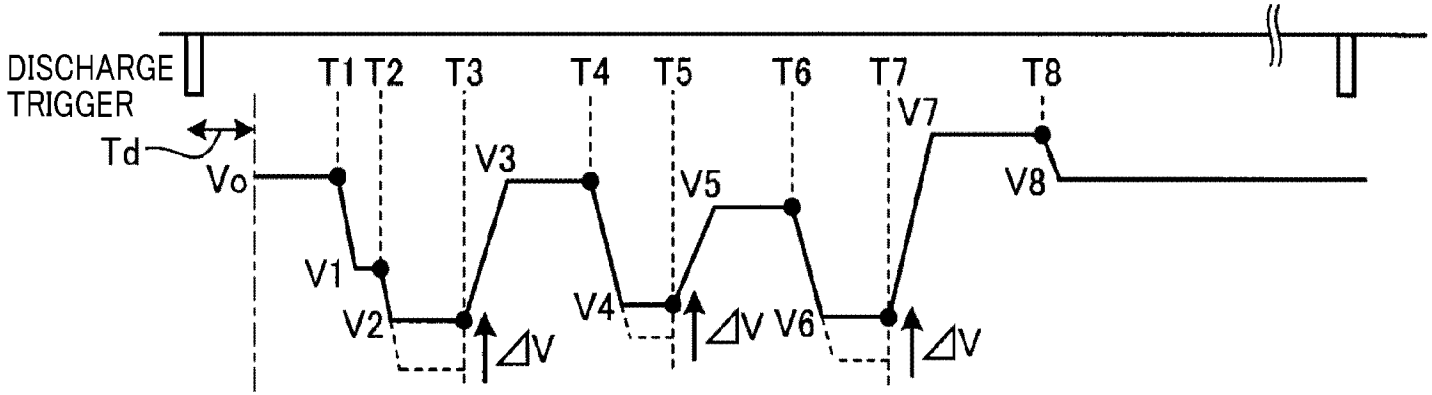

As illustrated in FIG. 13D, the falling voltages V2, V4, and V6 of the basic drive waveform may be weakened by a predetermined amount (ΔV). Alternatively, one of the falling voltages V2, V4, and V6 of the basic drive waveform may be weakened by a predetermined amount (ΔV). Thus, the discharge speed of droplets can be slowed down, and the landing timing can be delayed to align the landing positions.

Alternatively, both the application timing and the applied voltage may be corrected to delay the landing timing and align the landing positions.

Figure 15A:
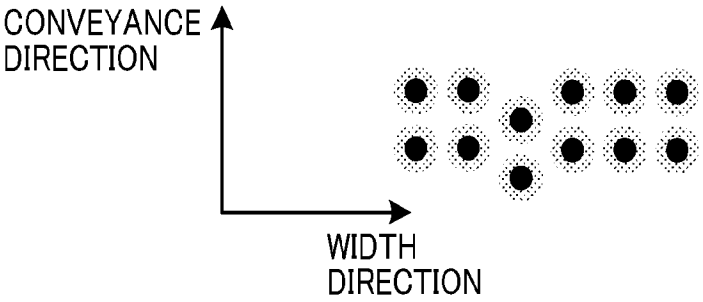
FIGS. 15A to 15D are diagrams illustrating other examples of the operation of correcting a drive waveform.

Next, FIGS. 15A to 15D are diagrams illustrating other examples of the operation of correcting a drive waveform. FIG. 15A illustrates an image in a case where the landing position of ink from a nozzle is delayed from the landing positions of nearby nozzles in the conveyance direction (a case where ink lands at a lower position in FIG. 15A). That is, in the example of FIG. 15A, the discharge timing of the nozzle 4 that discharges the third dot from the left is slower than the discharge timing of the other nozzles, and thus the landing position is shifted downward.

Figure 15B:
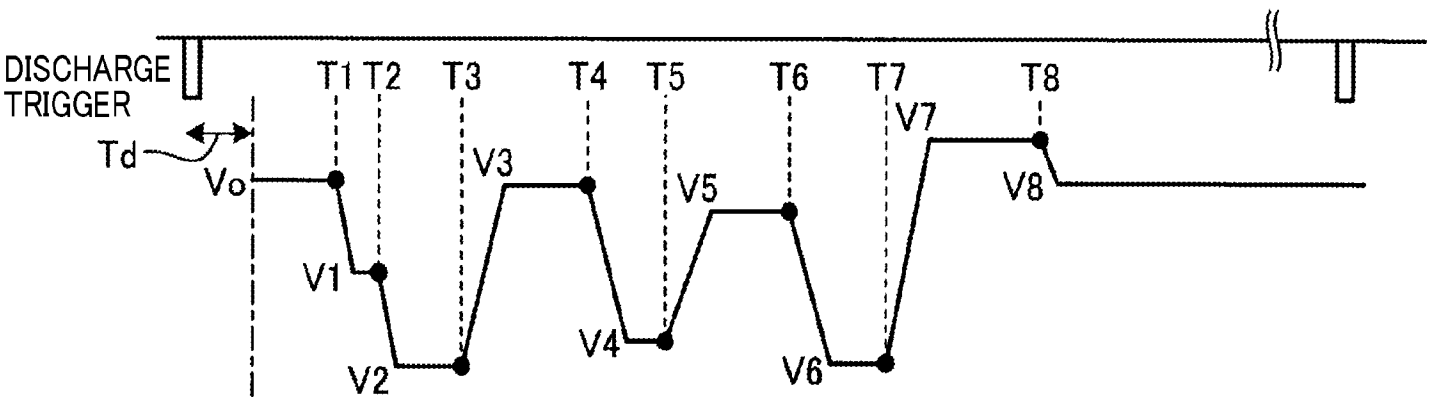
Figure 15C:
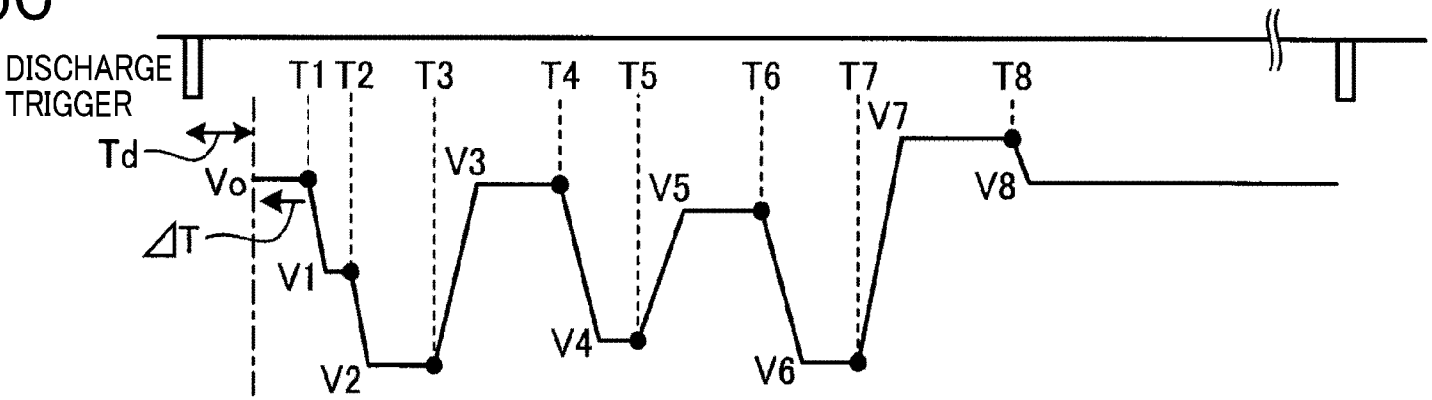

FIG. 15B illustrates an example of the basic drive waveform generated by the basic drive waveform generator 23 illustrated in FIG. 5. In the case of FIG. 15B, the drive waveform corrector (one of 21-1 to 21-N) corresponding to the nozzle 4 whose landing position is delayed from the other nozzles advances the application timing T1 of the basic drive signal of the basic drive waveform by a predetermined time (ΔT) as illustrated in FIG. 15C. Accordingly, since the discharge timing of liquid droplet is advanced, the landing timing can be earlier. Thus, the landing positions of the nozzles 4 can be aligned.

The timing to be changed is not limited to the timing T1. For example, the rising timings T3, T5, and T7 of the pulses may be earlier to advance the final landing positions.

Figure 15D:
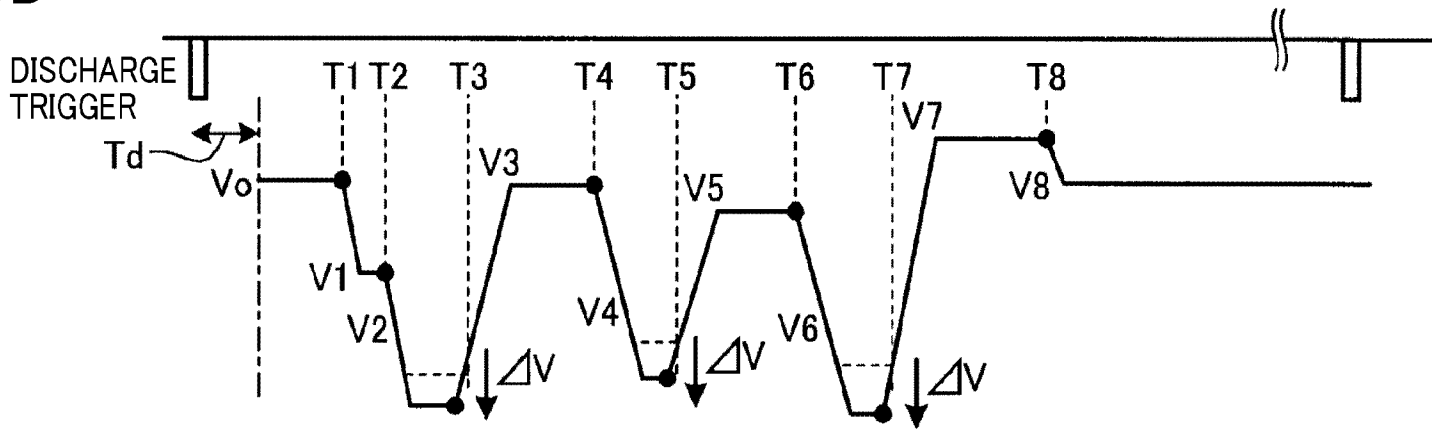

As illustrated in FIG. 15D, each (or any one) of the falling voltages V2, V4, and V6 of the basic drive waveform may be increased by ΔV. Thus, the discharge speed of the droplets can be increased, the landing timing can be advanced, and the landing positions can be aligned.

Alternatively, both the application timing and the applied voltage may be corrected to advance the landing timing and align the landing positions.

Effects of Embodiment

In a recording head, there are structural variations in piezoelectric elements, members, or the like provided for respective nozzles. Even if a drive signal having a drive waveform appropriately set in consideration of the ink droplet speed, the stability of the discharge state, and the like is used, there occur variations in the amount of ink droplets or the landing position and image quality deteriorates.

Hence, there is known a technique of controlling the landing positions of ink droplets in accordance with the variations in the landing positions.

However, the technique of controlling the landing position in accordance with the variation in the landing position has a problem in that it is difficult to control the landing position at a resolution higher than the resolution of the input image because the ink discharge timing is changed by shifting the pixel position of the input image.

More specifically, when the printing resolution of a line head engine is, for example, 1200 dot per inch (dpi) (21 μm square per pixel), the resolution of the input print job data is also 1200 dpi. Therefore, when the pixel position of the input print job data is shifted to change the ink discharge timing, the minimum control value is 21 μm.

However, since a step of 8.7 μm or more (an image defect called jaggy) is visually recognized due to human visual characteristics, jaggy is visually recognized at a control resolution of 21 μm Therefore, the control resolution needs to be 8.7 μm or less.

As is clear from the above description, in the liquid discharge system according to the present embodiment, the predetermined test chart printed by the liquid discharge apparatus 1 is imaged by the imaging apparatus 7. The computing apparatus 5 specifies the nozzle 4 in which the deviation of the landing position occurs based on the imaging data of the test chart. The liquid discharge apparatus 1 corrects the drive waveform of the nozzle 4 specified by the computing apparatus 5 according to the deviation amount of the landing position. Specifically, the application timing of the basic drive signal for driving the nozzle 4 in which the landing position deviation occurs is adjusted. For example, the applied voltage (falling voltage) of the basic drive signal for driving the nozzle 4 in which the landing position is displaced is adjusted. Alternatively, both the application timing and the applied voltage are corrected.

Accordingly, the landing position of the nozzle 4 in which the landing position is deviated can be adjusted with high resolution. Such a configuration can enhance the image quality of a print image printed by the liquid discharge system.

Finally, the above-described embodiments are presented as examples and are not intended to limit the scope of the present invention. The above-described novel embodiments can be implemented in other various forms, and various omissions, replacements, and changes can be made without departing from the scope of the invention.

For example, the "liquid discharge apparatus 1" is an apparatus that includes a liquid discharge head(s) or a liquid discharge unit(s) and drives the liquid discharge head(s) to discharge liquid. The liquid discharge apparatus 1 may be not only an apparatus capable of discharging liquid to an object to which liquid can adhere, but also an apparatus that discharges liquid into air or liquid.

In addition, the "liquid discharge apparatus 1" may include a unit related to feeding, conveying, and discharging of an object to which liquid can adhere, a pre-processing apparatus, a post-processing apparatus, or the like.

For example, the "liquid discharge apparatus 1" may also be an image forming apparatus which is an apparatus which forms an image on a sheet by discharging ink, or a three dimensional shaping apparatus (three dimensional shaping apparatus) which discharges shaping liquid onto a powder layer in which powder is formed in a layer shape in order to shape a three dimensional shaped object (three dimensional shaped object).

The "liquid discharge apparatus 1" is not limited to an apparatus in which a significant image such as a character or a figure is visualized by the discharged liquid. For example, an object that forms a pattern or the like having no meaning in itself or an object that forms a three-dimensional image is also included.

The "object to which liquid can adhere" is an object to which a liquid can adhere at least temporarily, and means an object to which a liquid adheres and is fixed, an object to which a liquid adheres and permeates, or the like. Examples of the "object to which liquid can adhere" include recording media, such as paper sheet, recording paper, recording sheet of paper, film, and cloth, electronic component, such as electronic substrate and piezoelectric element, and media, such as powder layer, organ model, and testing cell. The "material on which liquid can be adhered" includes any material on which liquid is adhered, unless particularly limited.

The material of the "object to which liquid can adhere" may be paper, thread, fiber, cloth, leather, metal, plastic, glass, wood, ceramics, or the like, as long as the liquid can adhere even temporarily. The liquid is not limited to any particular substance so long as the viscosity and surface tension thereof do not prevent the liquid itself from being discharged from the head. In particular, liquids expressing a viscosity of 30 mPa·s or less under normal temperature and normal pressure, or by heating or cooling, are preferable. More specifically, there are a solution, a suspension, an emulsion, and the like including a solvent such as water or an organic solvent, a colorant such as a dye or a pigment, a functionalizing material such as a polymerizable compound, a resin, or a surfactant, a biocompatible material such as deoxyribonucleic acid (DNA), amino acid, protein, calcium, or the like, edible materials such as natural pigments, and the like. The above-described examples can be used, for example, for inkjet inks, surface treatment liquids, liquids for forming constituent elements of electronic elements and light-emitting elements or resist patterns of electronic circuits, and material liquids for three-dimensional fabrication.

In addition, the "liquid discharge apparatus 1" is not limited to an apparatus in which a liquid discharging head and an object to which liquid can be attached move relative to each other. For example, the liquid discharge apparatus may be a serial head apparatus that moves the liquid discharge head or a line head apparatus that does not move the liquid discharge head.

Examples of the "liquid discharge apparatus 1" further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The above-described embodiments are illustrative and do not limit the present disclosure. In addition, the embodiments and modifications or variations thereof are included in the scope and the gist of the invention, and are included in the invention described in the claims and the equivalent scopes thereof. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A head driving device comprising:

a recording head including:

a plurality of nozzles; and a plurality of pressure generating elements corresponding to the plurality of nozzles;

an input-and-output interface configured to acquire correction information generated based on a chart image of a specific pattern for correcting a deviation amount of a landing position of each of the plurality of nozzles; and circuitry configured to:

set the correction information acquired by the input-and-output interface; and perform correction processing for correcting the deviation amount of the landing position on a driver for each of the plurality of nozzles of the recording head, in accordance with the correction information, wherein the circuitry is configured to perform the correction processing on a drive voltage of the driver and a supply timing of the drive voltage, so that the corrected drive voltage and the corrected supply timing are used together for discharging a single droplet.

2. The head driving device according to claim 1, wherein the chart image of the specific pattern is formed by an imaging apparatus physically separate from the head driving device, and wherein the correction information is formed by an apparatus physically separate from the head driving device and the imaging apparatus and set to the head driving device by the circuitry.

3. A liquid discharge apparatus comprising the head driving device according to claim 1.

4. A method of driving a recording head of a head driving device, the recording head including a plurality of nozzles and a plurality of pressure generating elements corresponding to the plurality of nozzles, the method comprising:

acquiring correction information for correcting a deviation amount of a landing position of each of the plurality of nozzles generated based on a charge chart image of a specific pattern;

setting the correction information acquired by the acquiring; and performing correction processing for correcting the deviation amount of the landing position on a driver for each of the plurality of nozzles of the recording head, in accordance with the correction information set by the setting, wherein the performing correction processing includes performing the correction processing on a drive voltage of the driver and a supply timing of the drive voltage, so that the corrected drive voltage and the corrected supply timing are used together for discharging a single droplet.

5. The head driving device according to claim 1, wherein the input-and-output interface is configured to acquire the correction information including the deviation amount of the landing position detected by determining a distance by which the landing position of a dot from each nozzle is separated from a reference position of the dot from each nozzle based on the chart image of the specific pattern.

6. The method according to claim 4, wherein the acquiring correction information for correcting the deviation amount of the landing position of each of the plurality of nozzles generated based on the chart image of the specific pattern comprises acquiring the correction information including the deviation amount of the landing position detected by determining a distance by which the landing position of a dot from each nozzle is separated from a reference position of the dot from each nozzle based on the chart image of the specific pattern.

* * * * *